US006832707B2

(12) United States Patent
Kendall et al.

(10) Patent No.: US 6,832,707 B2
(45) Date of Patent: Dec. 21, 2004

(54) REFRACTORY NOZZLE FOR A METALLURGICAL VESSEL

(75) Inventors: Martin Kendall, Hasselt (BE); Jean-Paul Verhoeven, Overpelt (BE); Marc Timmermans, Hasselt (BE)

(73) Assignee: Heraeus Electro-Nite International N.V., Houthalen (BE)

( * ) Notice: Subject to any disclaimer, the term of this patent is extended or adjusted under 35 U.S.C. 154(b) by 0 days.

(21) Appl. No.: 10/355,712

(22) Filed: Jan. 31, 2003

(65) Prior Publication Data

US 2003/0146553 A1 Aug. 7, 2003

(30) Foreign Application Priority Data

Feb. 1, 2002 (DE) ..... 102 04 305

(51) Int. Cl.[7] ..... B22D 35/06
(52) U.S. Cl. ..... 222/593; 222/606; 222/591
(58) Field of Search ..... 222/591, 592, 222/593, 606

(56) References Cited

U.S. PATENT DOCUMENTS 3,435,992 A 4/1969 Tisdale et al.
5,902,509 A * 5/1999 Bruckner et al. ..... 219/644

FOREIGN PATENT DOCUMENTS

| | | |
|---|---|---|
| DE | 26 25 742 A1 | 12/1976 |
| DE | 39 03 210 C1 | 6/1990 |
| DE | 195 26 970 A1 | 1/1997 |
| DE | 196 03 317 A1 | 3/1997 |
| DE | 196 03 607 A1 | 4/1997 |
| DE | 101 32 575 C1 | 7/2002 |
| DE | 101 60 070 A1 | 6/2003 |
| EP | 0 407 786 A1 | 1/1991 |
| JP | 54-6816 | 1/1979 |
| JP | 05337635 | 12/1993 |

* cited by examiner

*Primary Examiner*—Scott Kastler
(74) *Attorney, Agent, or Firm*—Akin Gump Strauss Hauer & Feld, L.L.P.

(57) ABSTRACT

A refractory nozzle is provided for a metallurgical vessel, in particular for steel melts, wherein the nozzle has a flow-through opening with an upper end, a lower end, and an inner wall laterally enclosing the flow-through opening. In order to improve known discharge nozzles, in particular with regard to their thermal shock resistance, a heater and/or a thermal insulating material, that dissolves or bums upon contact with fluid steel, is arranged along the inner wall in the flow-through opening.

17 Claims, 2 Drawing Sheets

REFRACTORY NOZZLE FOR A METALLURGICAL VESSEL

BACKGROUND OF THE INVENTION

The invention relates to a refractory nozzle for a metallurgical vessel, in particular for steel melts, having a flow-through opening with an upper end, a lower end and an inner wall that laterally encloses the flow-through opening.

Many of these types of discharge nozzles are known in metallurgy (see, for example, published patent applications: DE 195 26 970 A1, DE 196 18 605 A1, DE 196 51 533 A1, DE 196 51 534 A1, and EP 379 647 A2). One problem with these discharge nozzles is that they can be destroyed by the thermal stresses arising when the hot molten metal flows into them, or that metal is deposited on the inner wall of the discharge nozzles. In order to prevent this, the discharge nozzles are usually preheated. Gas burners or induction heaters are used to accomplish this. For example, in the case of gas burners, it is necessary that the preheating phase be terminated before the melt flows into the discharge nozzle, in order to be able to timely remove the burner from the flow-through area. However, the discharge nozzle cools during this transition period, so that the problems cited cannot be completely alleviated.

BRIEF SUMMARY OF THE INVENTION

The objective of the invention is to improve the known discharge nozzles and to design the preheating stage such that destruction due to thermal stresses or solidification of molten metal onto the inner wall of the discharge nozzle is substantially prevented.

The objective is achieved according to the invention in that either a heater or a thermal insulating material that dissolves or burns when contacted by fluid steel, or a combination thereof, is arranged along the inner wall in the flow-through opening. A relatively slow temperature increase of the material of the discharge nozzle, when the molten metal flows into it, is thereby achieved. Thermal stresses are minimized, and a too rapid cooling and solidification of the molten metal that comes into contact with the inner wall are substantially prevented. It has proven to be expedient if the thermal insulating material is cardboard or a material with a melting point that lies below the melting point of steel. A material of this type causes any molten metal that may perhaps solidify onto it to be flushed out of the discharge nozzle along with the melt flow after dissolving or melting of the material, thus not alloying with the discharge nozzle itself. In an advantageous manner, the thermal insulating material is formed from a fibrous material or is sprayed on.

The heater is expediently made of a steel. Metals with a lower melting point than steel can also be suitable. When the discharge nozzle is used for steel melts, the heater dissolves itself as the melt flows through, so that the melt can flow unhindered through the discharge nozzle. Any material at first solidifying onto the heater is re-dissolved and flushed out of the discharge nozzle.

It is advantageous if the heater and/or the thermal insulating material is formed of at least two parts extending in the longitudinal direction and arranged next to one another in the radial direction of the flow-through opening, since it is easier to manufacture an arrangement formed in this manner. In the process, it is practical to form the two parts with the same shape so as to simplify the manufacture. Here, the parts should mutually touch or have a mechanical (and/or electrical) contact to one another.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
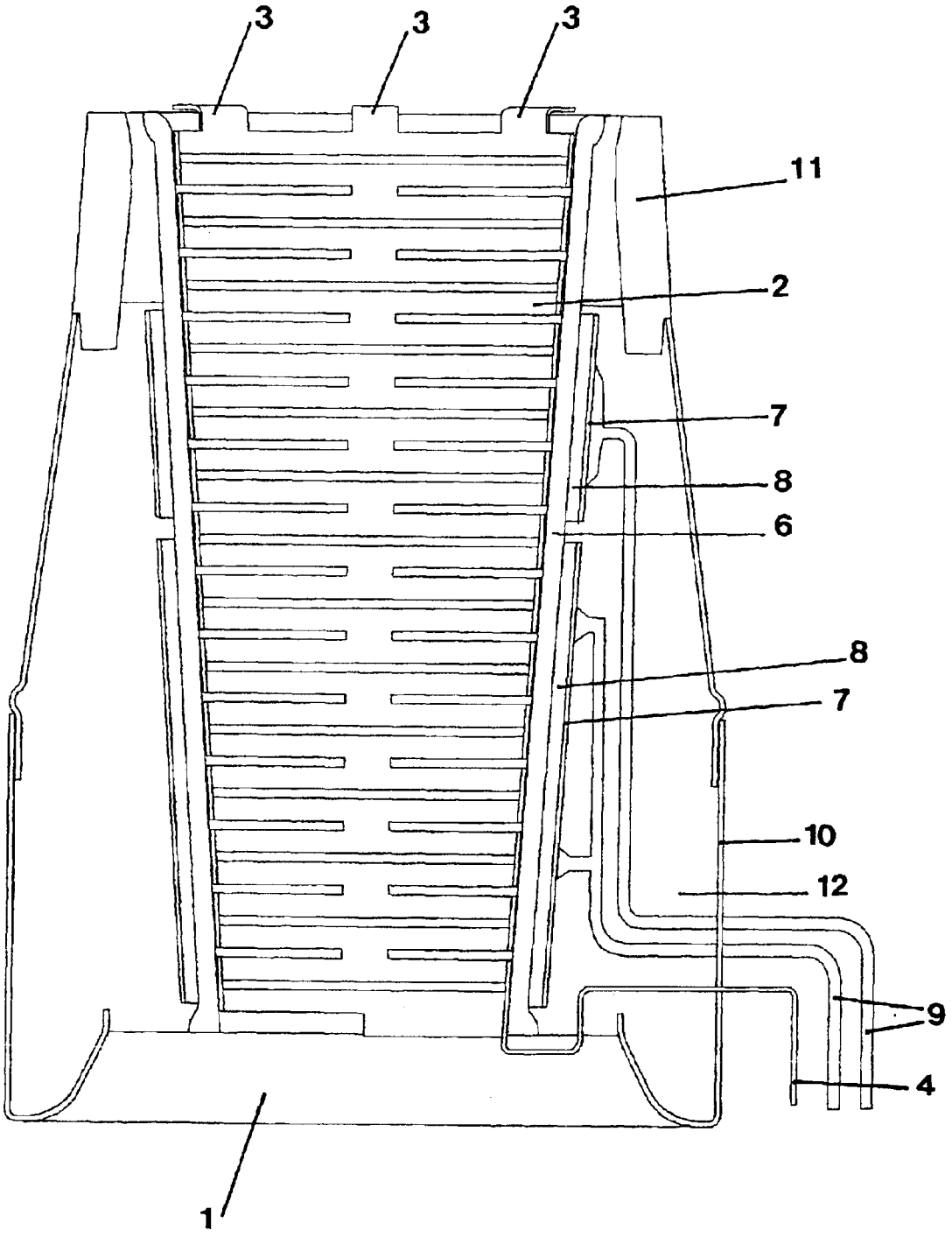
FIG. 1 is a longitudinal section through a discharge nozzle according to the invention.
Figure 2:
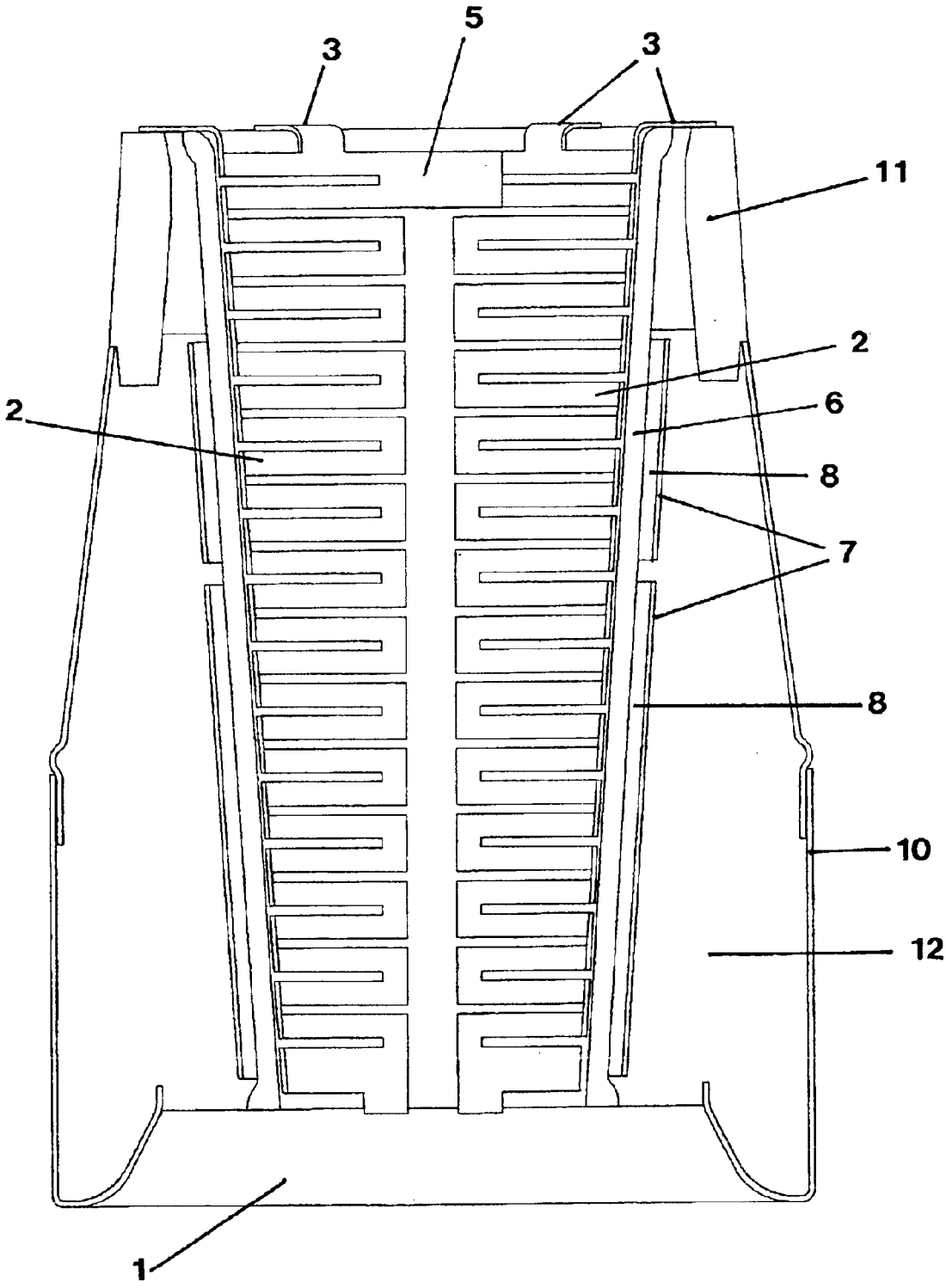
FIG. 2 is another longitudinal section, perpendicular to FIG. 1.

A heater 2 is arranged in the flow-through opening 1 of the discharge nozzle. The heater has a two-part (see FIG. 2) meander-shaped structure. It is hung in the discharge nozzle by support elements 3. These support elements 3 are located at the upper edge of the discharge nozzle. The heater 2 is made of steel. Due to the arrangement of the heater, the preheating phase can be extended in time up until the molten metal flows through the discharge nozzle. When using the discharge nozzle for steel melts, the heater 2 dissolves and is flushed from the discharge nozzle For its electrical connection the heater 2 has electrical contacts 4, of which only one is shown in the drawing for the sake of simplicity. It is logical to arrange the second contact on the corresponding end of the second part of the heater 2. The two-part structure of the heater can be seen in FIG. 2. The two parts of the heater 2 are connected together mechanically and electrically at their point of contact 5.

The inner wall 6 of the discharge nozzle is formed of zirconium dioxide. On its radially outer surface are electrodes 7, while between the electrodes 7 and the inner wall 6 of the discharge nozzle, a layer 8 made of chromium dioxide powder is arranged, by which the contact between the electrodes 7 and the inner wall 6 is produced. The electrodes 7 are fed to the outside as electrical contacts 9.

The discharge nozzle has an outer housing 10 made of steel, which is bounded at its upper end by a sintered ring 11 made of ceramic material. The remaining space inside the housing 10 is filled with a thermal/electrical insulating material 12. This insulating material 12 and the sintered ring 11 are formed of zirconium dioxide-mullite.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A refractory nozzle for a metallurgical vessel, the nozzle comprising a flow-through opening having an upper end, a lower end, and an inner wall laterally enclosing the flow-through opening, wherein at least one of a heater and a thermal insulating material is arranged along the inner wall in the flow-through opening, and wherein the at least one heater and/or thermal insulating material is made of a material that will substantially dissolve or burn upon contact with fluid steel, wherein the thermal insulating material comprises cardboard.

2. The refractory nozzle according to claim 1, wherein the heater is made of a steel.

3. The refractory nozzle according to claim 1, wherein the at least one heater and/or thermal insulating material comprises at least two parts extending in a longitudinal direction and arranged next to one another in a radial direction of the flow-through opening.

4. The refractory nozzle according to claim 3, wherein the parts are formed with a same shape.

5. The refractory nozzle according to claim 3, wherein the parts mutually touch.

6. The refractory nozzle according to claim 3, wherein the parts are connected to each other at least one of mechanically and electrically.

7. The refractory nozzle according to claim 1, wherein the metallurgical vessel is adapted for holding and discharging steel melts.

8. A refractory nozzle for a metallurgical vessel, the nozzle comprising a flow-through opening having an upper end, a lower end, and an inner wall laterally enclosing the flow-through opening, wherein at least one of a heater and a thermal insulating material is arranged along the inner wall in the flow-through opening, and wherein the at least one heater and/or thermal insulating material is made of a material that will substantially dissolve or burn upon contact with fluid steel, and wherein the heater is made of a steel.

9. The refractory nozzle according to claim 8, wherein the thermal insulating material comprises a material with a melting point below a melting point of steel.

10. The refractory nozzle according to claim 8, wherein the thermal insulating material comprises cardboard.

11. The refractory nozzle according to claim 8, wherein the thermal insulating material comprises a fibrous material.

12. The refractory nozzle according to claim 8, wherein the thermal insulating material comprises a material that is sprayed on.

13. The refractory nozzle according to claim 8, wherein the at least one heater and/or thermal insulating material comprises at least two parts extending in a longitudinal direction and arranged next to one another in a radial direction of the flow-through opening.

14. The refractory nozzle according to claim 13, wherein the parts are formed with a same shape.

15. The refractory nozzle according to claim 13, wherein the parts mutually touch.

16. The refractory nozzle according to claim 13, wherein the parts are connected to each other at least one of mechanically and electrically.

17. The refractory nozzle according to claim 8, wherein the metallurgical vessel is adapted for holding and discharging steel melts.

* * * * *